US006840145B1

(12) United States Patent
Lee

(10) Patent No.: US 6,840,145 B1
(45) Date of Patent: Jan. 11, 2005

(54) DEVICE FOR TRIMMING CORNER OR SHEET MEMBER

(76) Inventor: Luca Lee, P.O. Box 63-99, Taichung (TW), 406

( * ) Notice: Subject to any disclaimer, the term of this patent is extended or adjusted under 35 U.S.C. 154(b) by 12 days.

(21) Appl. No.: 10/618,361

(22) Filed: Jul. 8, 2003

(51) Int. Cl.[7] ..... B26D 5/08

(52) U.S. Cl. ..... 83/167; 83/589; 83/467.1; 83/564; 83/605; 83/694

(58) Field of Search ..... 83/167, 589, 449, 83/467.1, 564, 605, 694, 681, 684, 685, 686; 30/178, 229, 359, 363, 367

(56) References Cited

U.S. PATENT DOCUMENTS 2,082,867 A * 6/1937 Andersen ..... 83/468.93
2,163,868 A * 6/1939 Christie ..... 83/468.93
4,611,519 A * 9/1986 Hagerty ..... 83/389
D319,172 S * 8/1991 Vaccaro ..... D8/98
6,016,733 A * 1/2000 Lin ..... 83/589
6,209,434 B1 * 4/2001 Kim et al. ..... 83/549
6,736,045 B2 * 5/2004 Chang ..... 83/549

* cited by examiner

*Primary Examiner*—Boyer D. Ashley

(57) ABSTRACT

A corner trimming device includes a base having a seat and a platform to support sheet members to be cut or trimmed, the base includes a channel formed between the seat and the platform. A cutter blade includes a bar engaged into the channel of the base and secured between the seat and the platform and includes an opening to form an angle arm having an inner rounded corner edge formed as a movable cutting edge. A handle is pivotally secured to the base and engaged with the angle arm, to move the cutting edge of the cutter blade downwardly beyond the rounded corner edge of the seat, and to cut or trim corner portion of the sheet members.

9 Claims, 4 Drawing Sheets

DEVICE FOR TRIMMING CORNER OR SHEET MEMBER

BACKGROUND OF THE INVENTION

1. Field of the Invention

The present invention relates to a corner trimming device, and more particularly to a corner trimming device having a simplified and effective structure to trim corners of paper or sheet members.

2. Description of the Prior Art

In many circumstances, such as making decorative cards, birthday cards, playbills, etc., the corners of the paper or sheet members may be required to be cut or trimmed to rounded structures or contours.

However, the typical cutting or trimming devices have been provided to cut or trim straight edges or sides of paper or sheet members only, but may not be used to cut or trim the corners of the paper or sheet members.

People are thus required to use, scissor devices to slowly and carefully cut or trim the corners of the paper or sheet members; i.e., the corners of the paper or sheet members may not be easily and quickly cut or trimmed with the scissor devices, and may be easily cut or trimmed into non-curved or serrated contours.

For cutting or trimming the corners of the paper or sheet members, some of the typical corner trimming devices have been developed and comprise a corner cutter blade to be moved downwardly toward or against the corner or edge portion of a base member, in order to directly cut or trim the corners of the paper or sheet members.

A spring member is further required to be provided and engaged with the corner cutter blade, in order to bias or force the corner cutter blade away from the corner or edge portion of the base member and the paper or sheet members. However, it will be difficult to install the spring member into the corner trimming devices, and to engage the spring member with the corner cutter blade.

The present invention has arisen to mitigate and/or obviate the afore-described disadvantages of the conventional corner trimming devices.

SUMMARY OF THE INVENTION

The primary objective of the present invention is to provide a corner trimming device including a simplified and effective structure to easily and effectively cut or trim the corner areas of the paper or sheet members.

In accordance with one aspect of the invention, there is provided a corner trimming device comprising a base including a seat and a platform extended therefrom, to support sheet members to be cut or trimmed, the base including a channel formed between the seat and the platform, and the seat including a rounded corner edge, a cutter blade including a bar engaged into the channel of the base, to retain the bar between the seat and the platform, and to secure the cutter blade on the base, the cutter blade including an opening formed therein to define an angle arm, the angle arm including an inner peripheral portion having a rounded corner edge formed therein to form as a movable cutting edge, the cutter blade being arranged to have the cutting edge located above and spaced away from the rounded corner edge of the seat, and to form a gap between the cutting edge of the cutter blade and the rounded corner edge of the seat, and to receive the sheet members to be cut or trimmed, and a handle pivotally secured to the base, and engaged with the angle arm, for moving the cutting edge of the cutter blade downwardly beyond the rounded corner edge of the seat, and to cut or trim corner portion of the sheet members. The corner trimming device includes a simplified and effective structure to easily and effectively cut or trim the corner areas of the paper or sheet members.

The channel of the base includes an end portion having a width greater than that of the channel of the base, to allow the bar of the cutter blade to engage into the channel of the base.

The base includes two apertures formed therein, the handle includes two shafts extended therefrom and rotatably engaged into the apertures of the base, to rotatably secure the handle to the base.

The base includes at least one guide fence extended upwardly from the platform, for engaging with the sheet members, and for guiding the sheet members to be supported on the seat and the platform.

A plate may further be provided and secured on the seat, and includes a fixed cutter edge formed thereon, the cutting edge of the cutter blade is movable downwardly beyond the fixed cutter edge of the plate, to cut or trim the corner portion of the sheet members.

The seat includes at least one projection extended therefrom, the plate includes at least one orifice formed therein to receive the projection of the seat and to anchor the plate on the seat.

The seat includes a screw hole formed therein, the plate includes a hole formed therein and aligned with the screw hole of the seat, and a fastener engaged through the hole of the plate and threaded with the screw hole of the seat, to secure the plate on the seat.

The base includes a chamber formed therein and defined by a peripheral wall, and located beside the rounded corner edge of the seat, to receive cut chips from the sheet members.

The base includes a stop extended from the peripheral wall, to engage with the handle, and to limit a downward movement of the handle relative to the base.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
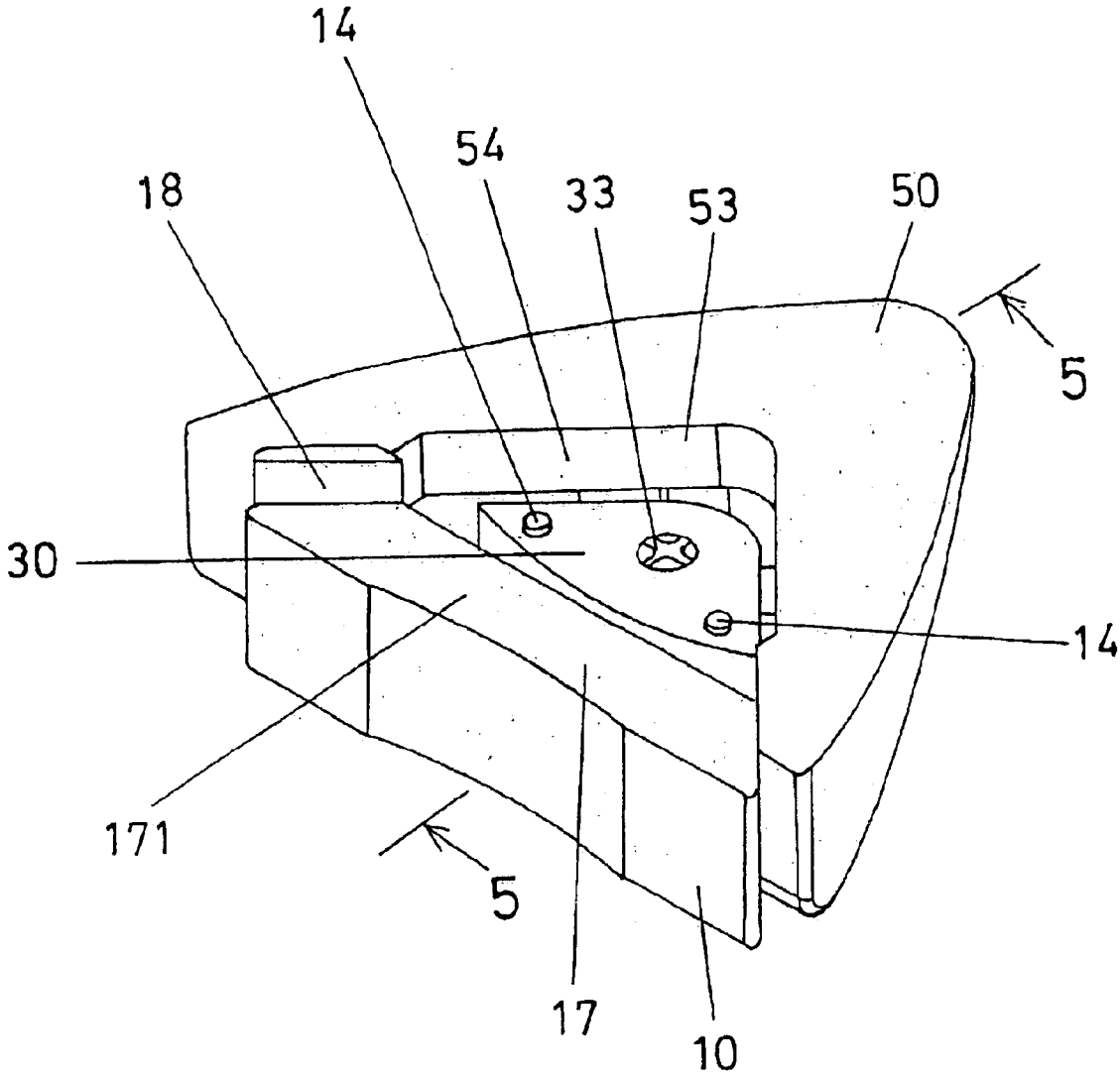
FIG. 1 is a perspective view of a corner trimming device in accordance with the present invention.
Figure 2:
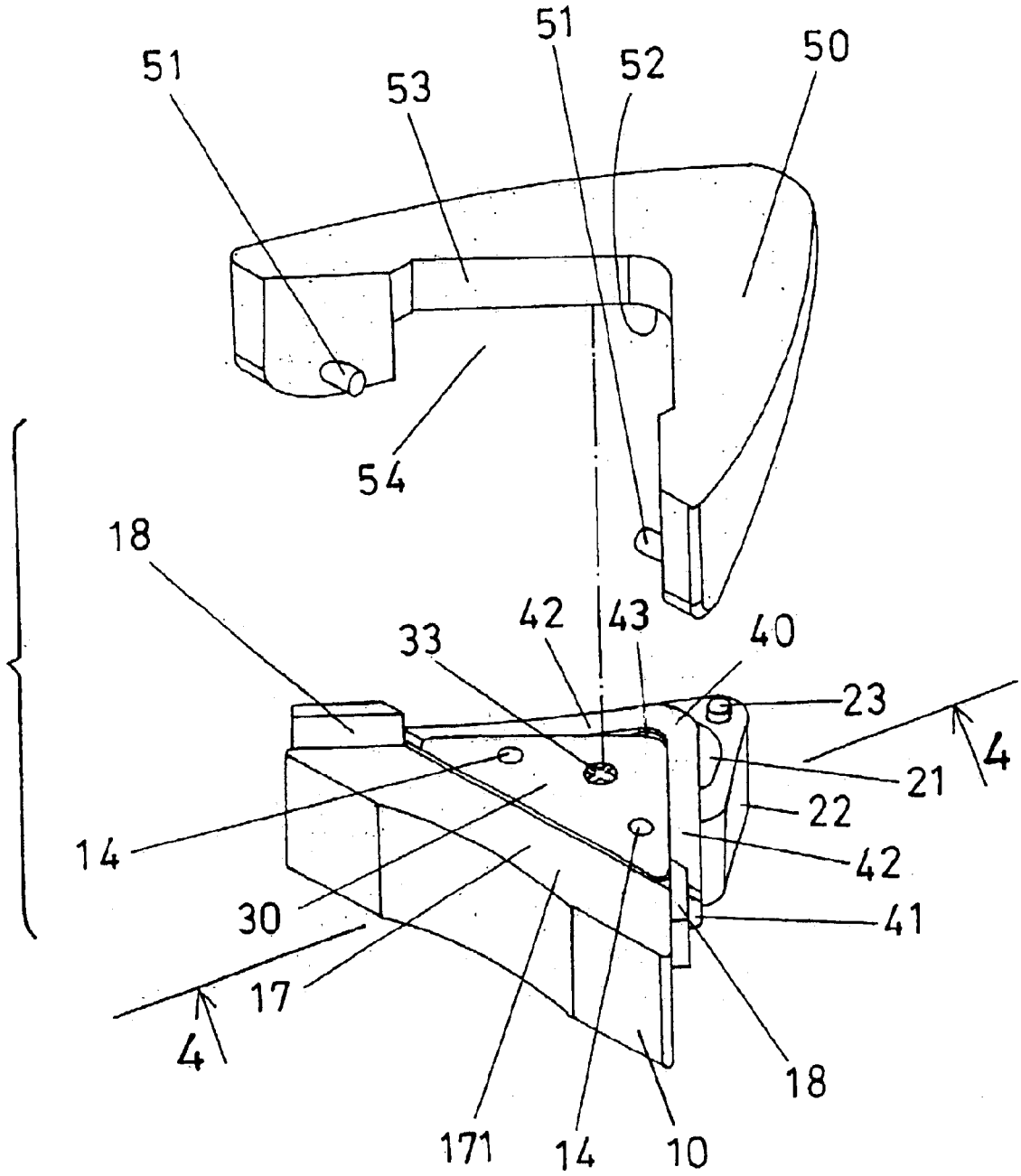
FIG. 2 is a partial exploded view of the corner trimming device.
Figure 3:
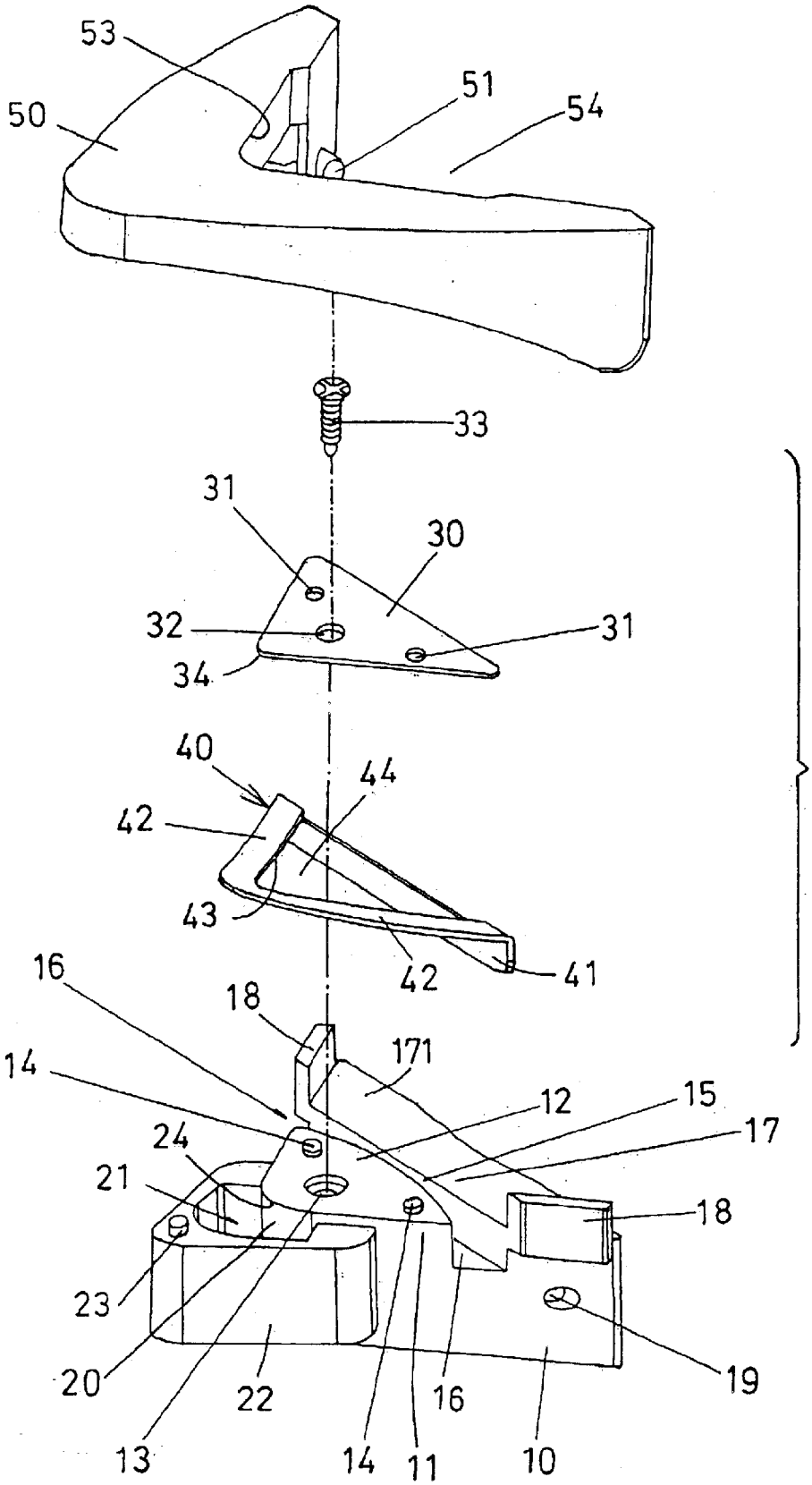
FIG. 3 is an exploded view of the corner trimming device.

Referring to the drawings, and initially to FIGS. 1–3, a corner trimming device in accordance with the present invention comprises a base 10 including a seat 11 extended upwardly therefrom and having a flat upper surface 12 formed thereon, and having a screw hole 13 formed in the upper portion thereof, and one or more, such as two projections 14 extended upwardly from the flat upper surface 12 thereof.

The base 10 further includes a platform 17 provided thereon or extended upwardly therefrom, to form or define a channel 15 between the seat 111 and the platform 17. The platform 17 includes an upper surface 171 slightly higher than the flat upper surface 12 of the seat 10, to support the paper or sheet members 90 to be cut or trimmed by the corner trimming device. The channel 15 of the base 10 includes one or more end portions 16 each having a greater width than the middle portion thereof.

The base 10 further includes one or more, such as two guide fences 18 extended upwardly from the platform 17 and perpendicular to each other, to engage with edges of the paper or sheet members 90, and to guide the corner area of the paper or sheet members 90 into the corner trimming device. The base 10 includes one or more, such as two apertures 19 formed therein, such as located below the guide fences 18 respectively.

As best shown in FIG. 3, the seat 11 includes a curved or rounded corner portion 20 formed or provided therein, and preferably having a shape corresponding to the corner portion of the sheet member 90 to be formed or shaped by the corner trimming device. The seat 11 thus includes a curved or rounded corner edge 24 formed in the upper peripheral portion thereof.

The base 10 includes a chamber 21 formed therein and located beside the curved or rounded corner portion 20 of the seat 11, and formed or defined by a peripheral wall 22, to receive the cut chips or portions cut from the paper or sheet members 90. The peripheral wall 22 preferably or selectively includes a stop 23 extended upwardly therefrom, and preferably located distal to the seat 11.

A plate 30, such as a fixed or anvil plate 30 is preferably or selectively provided to be disposed on top of the seat 11, and includes one or more, such as two orifices 31 formed therein to receive the projections 14 of the seat 11, and to anchor or position the plate 30 on top of the seat 11, and to prevent the plate 30 from being moved relative to the seat 11.

The plate 30 further includes a hole 32 formed therein to receive a fastener 33 which may be threaded with the screw hole 13 of the seat 11, to secure the plate 30 on top of the seat 11, and to prevent the plate 30 from being disengaged from the seat 11. The plate 30 includes a rounded corner edge 34 to be aligned with the rounded corner edge 24 of the seat 11, for forming a fixed cutter edge 34.

A spring cutter blade 40 includes a bar 41 provided on one side and to be engaged into the channel 15 of the base 10, and to be retained between the seat 11 and the platform 17 by such as a force-fitted engagement, in order to secure or position the spring cutter blade 40 on the base 10. The bar 41 of the spring cutter blade 40 may be easily engaged into the channel 15, that is formed or defined between the seat 11 and the platform 17, via the end portions 16 of the channel 15 of the base 10 that has a greater width than that of the channel 15 of the base 10.

The spring cutter blade 40 includes a substantially C-shaped, or L-shaped or V-shaped angle arm 42 having a rounded corner edge 43 formed in the inner peripheral portion thereof, and formed or defined by an opening 44 therein, for forming as a movable cutting edge 43, which is to be moved relative to or beyond the fixed cutter edge 34 or the rounded corner edge 34 of the plate 30 and/or the rounded corner edge 24 of the seat 11, to cut or trim the sheet member 90.

Figure 4:
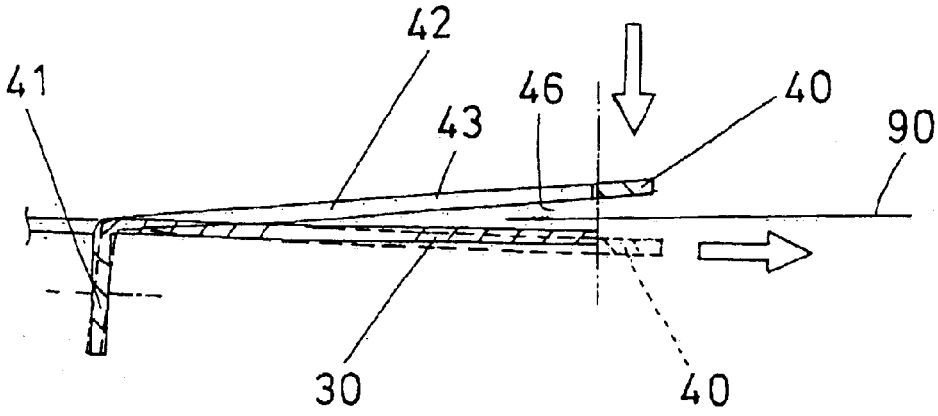
FIG. 4 is a partial cross sectional view taken along lines 4—4 of FIG. 2.
Figure 5:
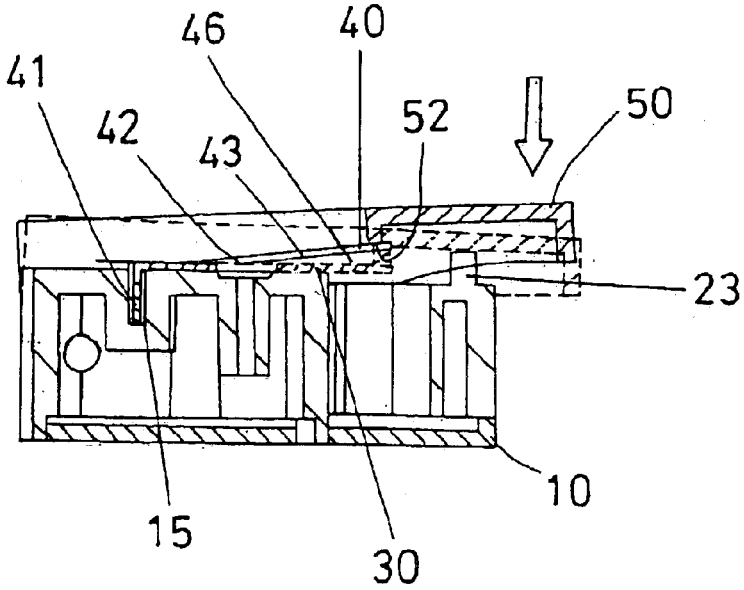
FIG. 5 is a cross sectional view taken along lines 5—5 of FIG. 1.

The spring cutter blade 40 includes a resilience or is preformed to have the movable cutting edge 43 extended or located above and spaced away from the fixed cutter edge 34 or the rounded corner edge 34 of the plate 30, and to form or define a passage or gap 46 between the movable cutting edge 43 of the spring cutter blade 40 and the fixed cutter edge 34 or the rounded corner edge 34 of the plate 30, best shown in FIGS. 4, 5.

In operation, the rounded corner edge 43 of the angle arm 42 of the cutter blade 40 may be moved downwardly beyond the fixed cutter edge 34 or the rounded corner edge 34 of the plate 30 and/or the rounded corner edge 24 of the seat 11, best shown in FIGS. 4, 5, in order to cut or trim the corner portion of the sheet member 90. The cut chips or portions cut from the paper or sheet members 90 may be received or collected in the chamber 21 of the base 10.

A substantially C-shaped, or L-shaped or V-shaped handle 50 may further be provided and may include one or more shafts 51 extended therefrom and rotatably engaged into the corresponding apertures 19 of the base 10, to rotatably secure the handle 50 to the base 10. The handle 50 includes a bottom portion 52 (FIGS. 2, 5) to be contacted or engaged with the cutter blade 40, to force the cutter blade 40 downwardly toward the plate 30 and the seat 11, and in order to cut or trim the corner portion of the sheet member 90.

The handle 50 includes a substantially C-shaped, or L-shaped or V-shaped inner peripheral surface 53 formed therein and formed or defined by a notch 54 for receiving the plate 30 and/or the seat 11, and for allowing the corner edge 43 of the angle arm 42 of the cutter blade 40 to be moved downwardly beyond the fixed cutter edge 34 of the plate 30 and/or the rounded corner edge 24 of the seat 11. The stop 23 of the peripheral wall 22 of the base 10 may be engaged with the handle 50 (FIG. 5), to limit the downward movement of the handle 50 relative to the base 10.

Accordingly, the corner trimming device in accordance with the present invention includes a simplified and effective structure to easily and effectively cut or trim the corner areas of the paper or sheet members.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A corner trimming device comprising:

a base including a seat and a platform extended therefrom, to support sheet members to be cut or trimmed, said base including a channel formed between said seat and said platform, and said seat including a rounded corner edge, a cutter blade including a bar engaged into said channel of said base, to retain said bar between said seat and said platform, and to secure said cutter blade on said base, said cutter blade including an opening formed therein to define an angle arm, said angle arm including an inner peripheral portion having a rounded corner edge formed therein to form as a movable cutting edge, said cutter blade being arranged to have said cutting edge located above and spaced away from said rounded corner edge of said seat, and to form a gap between said cutting edge of said cutter blade and said rounded corner edge of said seat, and to receive the sheet members to be cut or trimmed, and a handle pivotally secured to said base, and engaged with said angle arm, for moving said cutting edge of said cutter blade downwardly beyond said rounded corner edge of said seat, and to cut or trim corner portion of the sheet members.

2. The corner trimming device as claimed in claim 1, wherein said channel of said base includes an end portion having a width greater than that of said channel of said base, to allow said bar of said cutter blade to engage into said channel of said base.

3. The corner trimming device as claimed in claim 1, wherein said base includes two apertures formed therein, said handle includes two shafts extended therefrom and rotatably engaged into said apertures of said base, to rotatably secure said handle to said base.

4. The corner trimming device as claimed in claim 1, wherein said base includes at least one guide fence extended upwardly from said platform, for engaging with the sheet members, and for guiding the sheet members to be supported on said seat and said platform.

5. The corner trimming device as claimed in claim 1 further comprising a plate secured on said seat, and including a fixed cutter edge formed thereon, said cutting edge of said cutter blade being movable downwardly beyond said fixed cutter edge of said plate, to cut or trim the corner portion of the sheet members.

6. The corner trimming device as claimed in claim 5, wherein said seat includes at least one projection extended therefrom, said plate includes at least one orifice formed therein to receive said at least one projection of said seat and to anchor said plate on said seat.

7. The corner trimming device as claimed in claim 5, wherein said seat includes a screw hole formed therein, said plate includes a hole formed therein and aligned with said screw hole of said seat, and a fastener engaged through said hole of said plate and threaded with said screw hole of said seat, to secure said plate on said seat.

8. The corner trimming device as claimed in claim 1, wherein said base includes a chamber formed therein and defined by a peripheral wall, and located beside said rounded corner edge of said seat, to receive cut chips from the sheet members.

9. The corner trimming device as claimed in claim 8, wherein said base includes a stop extended from said peripheral wall, to engage with said handle, and to limit a downward movement of said handle relative to said base.

* * * * *